US010635038B2

(12) United States Patent
Yamaura et al.

(10) Patent No.: US 10,635,038 B2
(45) Date of Patent: Apr. 28, 2020

(54) IMAGE FORMING APPARATUS

(71) Applicant: FUJI XEROX CO., LTD., Tokyo (JP)

(72) Inventors: Masaaki Yamaura, Kanagawa (JP); Satoshi Shigezaki, Kanagawa (JP); Yoko Miyamoto, Kanagawa (JP); Yoshiyuki Tominaga, Kanagawa (JP); Noboru Hirakawa, Kanagawa (JP); Jun Kuwabara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 135 days.

(21) Appl. No.: 15/979,478

(22) Filed: May 15, 2018

(65) Prior Publication Data

US 2019/0187599 A1 Jun. 20, 2019

(30) Foreign Application Priority Data

Dec. 15, 2017 (JP) ..... 2017-240101

(51) Int. Cl.
*G03G 15/00* (2006.01)
*G03G 15/01* (2006.01)
*G03G 15/16* (2006.01)

(52) U.S. Cl.
CPC ..... *G03G 15/5029* (2013.01); *G03G 15/0131* (2013.01); *G03G 15/1615* (2013.01); *G03G 15/1675* (2013.01); *G03G 15/5004* (2013.01)

(58) Field of Classification Search
CPC ..... G03G 15/1675; G03G 15/1615; G03G 15/5004; G03G 15/5029; G03G 15/0131; G03G 15/0136
See application file for complete search history.

(56) References Cited

U.S. PATENT DOCUMENTS

| | | | | |
|---|---|---|---|---|
| 4,338,017 | A * | 7/1982 | Nishikawa | G03G 15/1675 399/145 |
| 9,599,937 | B2 | 5/2017 | Nagata | |
| 10,401,775 | B1 * | 9/2019 | Tokuyama | B65H 5/062 |
| 2009/0129831 | A1 * | 5/2009 | Sakashita | G03G 15/1675 399/309 |
| 2015/0338785 | A1 * | 11/2015 | Ai | G03G 15/161 399/101 |
| 2016/0154345 | A1 * | 6/2016 | Nagata | G03G 15/1665 399/315 |

FOREIGN PATENT DOCUMENTS

| | | |
|---|---|---|
| JP | H11190945 | 7/1999 |
| JP | 2011186168 | 9/2011 |
| JP | 2016102909 | 6/2016 |

* cited by examiner

*Primary Examiner* — Carla J Therrien
(74) *Attorney, Agent, or Firm* — JCIPRNET

(57) ABSTRACT

An image forming apparatus includes a transfer unit that transfers a toner image to a transfer body; a guide unit disposed upstream of the transfer unit in a direction in which the transfer body is transported, the guide unit guiding the transfer body; a supply unit that supplies a transfer voltage to the transfer unit; and a setting unit that sets the transfer voltage supplied by the supply unit so that a transfer current supplied to the transfer unit is within a predetermined range at the time when the transfer body becomes separated from the guide unit.

13 Claims, 18 Drawing Sheets

FIG. 10

| | CONDITION 1 | CONDITION 2 | CONDITION 3 | CONDITION 4 | CONDITION 5 |
|---|---|---|---|---|---|
| AMOUNT OF INDENTATION IN SECOND TRANSFER NIP (mm) | FIXED AT -0.3 mm | FIXED AT -0.3 mm | INCREASED FROM -0.3 mm TO +0.3 mm | FIXED AT +0.3 mm | FIXED AT +0.3 mm |
| SECOND TRANSFER VOLTAGE Vbur (kV) | FIXED AT -2.0 kV | INCREASED FROM -2.0 kV TO -2.9 kV | FIXED AT -2.0 kV | FIXED AT -2.0 kV | INCREASED FROM -2.0 kV TO -2.9 kV |
| SOLID IMAGE IN WHITE (W) ONLY | R (CLEAR DENSITY STEP) | G (NO DENSITY STEP) | G (NO DENSITY STEP) | G (NO DENSITY STEP) | G (NO DENSITY STEP) |
| SOLID IMAGE IN WHITE (W) + (M) + (C) | R (CLEAR DENSITY STEP) | G (NO DENSITY STEP) | Y (DIFFERENCE IN HUE) | Y (DIFFERENCE IN HUE) | G (NO DENSITY STEP) |
| BAND-SHAPED WHITE (W) IMAGE AT LEADING END | G (SCATTERING PREVENTED) | G (SCATTERING PREVENTED) | G (SCATTERING PREVENTED) | R (SCATTERING OCCURS) | R (SCATTERING OCCURS) |

ENLARGED VIEW OF TONER SCATTERING

IMAGE FORMING APPARATUS

CROSS-REFERENCE TO RELATED APPLICATIONS

This application is based on and claims priority under 35 USC 119 from Japanese Patent Application No. 2017-240101 filed Dec. 15, 2017.

BACKGROUND

Technical Field

The present invention relates to an image forming apparatus.

SUMMARY

According to an aspect of the invention, there is provided an image forming apparatus including a transfer unit that transfers a toner image to a transfer body; a guide unit disposed upstream of the transfer unit in a direction in which the transfer body is transported, the guide unit guiding the transfer body; a supply unit that supplies a transfer voltage to the transfer unit; and a setting unit that sets the transfer voltage supplied by the supply unit so that a transfer current supplied to the transfer unit is within a predetermined range at the time when the transfer body becomes separated from the guide unit.

BRIEF DESCRIPTION OF THE DRAWINGS

Exemplary embodiments of the present invention will be described in detail based on the following figures, wherein:

FIG. 10 is a table showing conditions and results of image evaluation according to examples;

DETAILED DESCRIPTION

Figure 1:
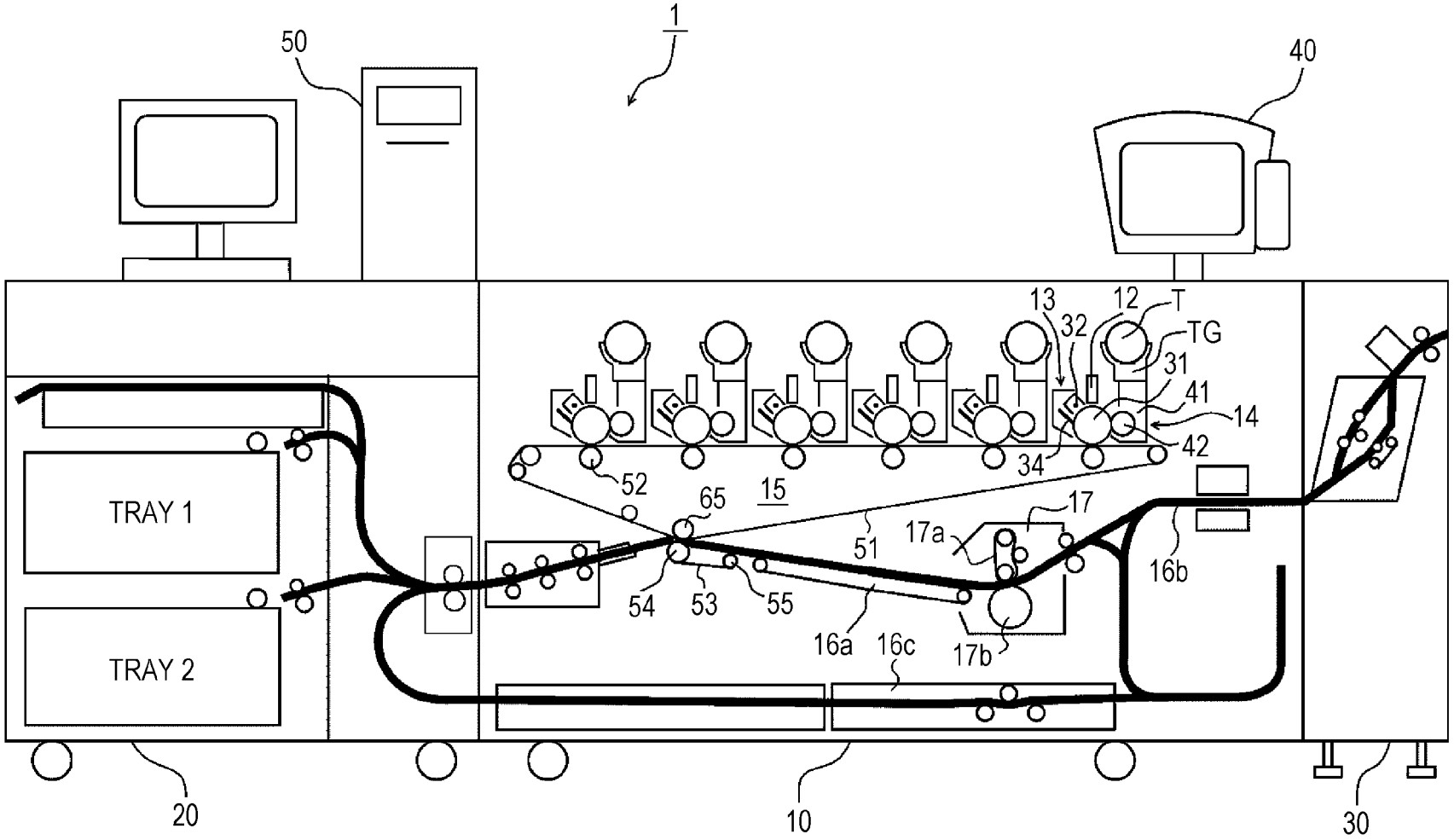
FIG. 1 is a schematic sectional view illustrating an example of the structure of an image forming apparatus according to a first exemplary embodiment.

The present invention will be described in further detail by way of exemplary embodiments and examples with reference to the drawings. However, the present invention is not limited to the exemplary embodiments and examples.

It is to be noted that the drawings referred to in the following description are schematic, and that dimensional ratios, for example, in the drawings differ from the actual dimensional ratios. Components other than those necessary to be described to facilitate understanding are omitted as appropriate in the drawings.

Figure 2:
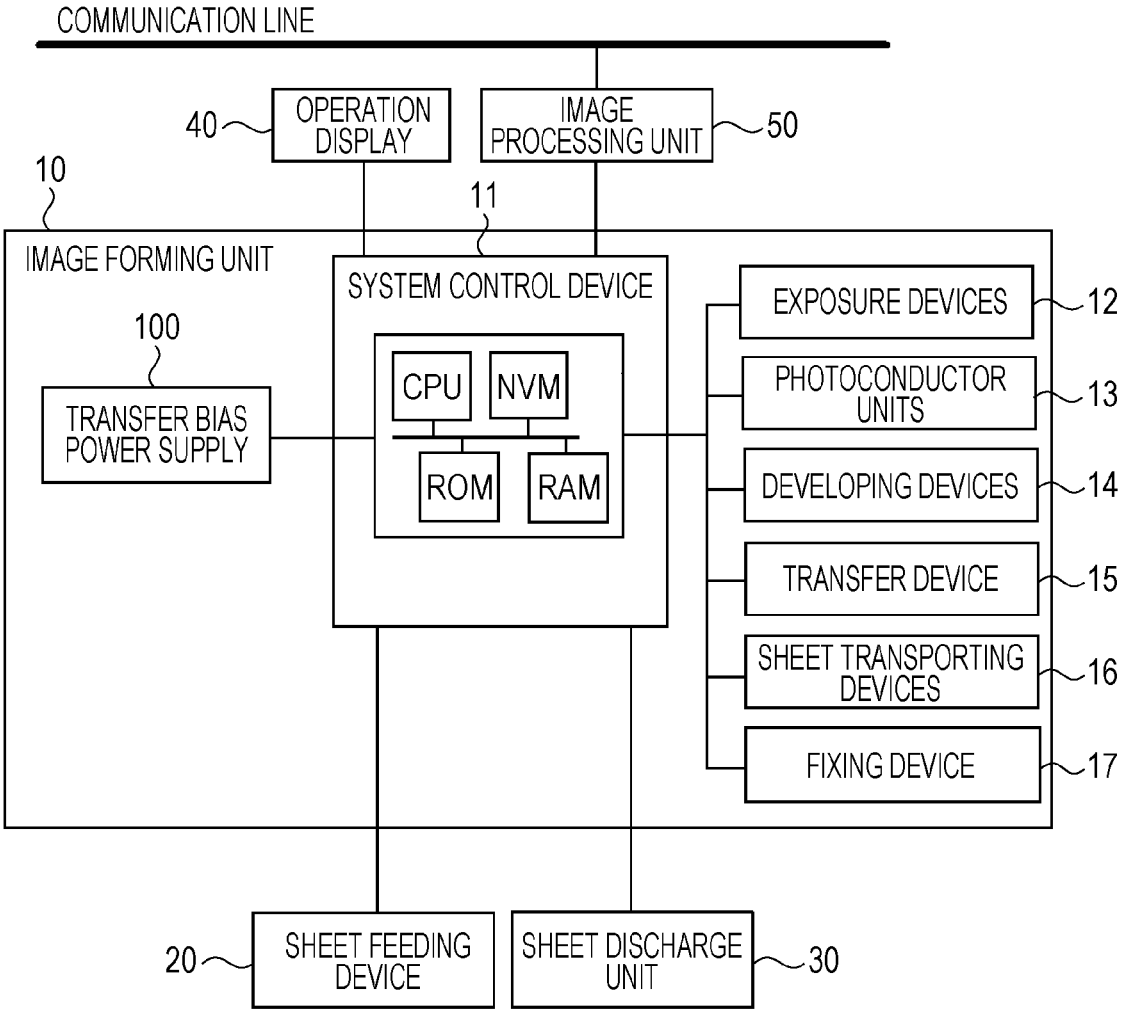
FIG. 2 is a block diagram illustrating the functional configuration of the image forming apparatus according to the first exemplary embodiment.

First Exemplary Embodiment (1) Overall Structure and Operation of Image Forming Apparatus (1.1) Overall Structure of Image Forming Apparatus FIG. 1 is a schematic sectional view illustrating an example of the structure of an image forming apparatus 1 according to the present exemplary embodiment. FIG. 2 is a block diagram illustrating the functional configuration of the image forming apparatus 1.

The image forming apparatus 1 includes an image forming unit 10; a sheet feeding device 20 attached to one end of the image forming unit 10; a sheet discharge unit 30 that is attached to the other end of image forming unit 10 and to which a printed paper sheet P is discharged; an operation display 40; and an image processing unit 50 that generates image information based on printing information transmitted from a high-order device.

The image forming unit 10 includes a system control device 11 (not shown in FIG. 1), exposure devices 12, photoconductor units 13, developing devices 14, a transfer device 15, sheet transporting devices 16*a*, 16*b*, and 16*c*, a fixing device 17, and a driving device 18 (not shown in FIG. 1). The image forming unit 10 forms a toner image based on image information received from the image processing unit 50 on a paper sheet P that serves as a recording medium and that is fed by the sheet feeding device 20.

The sheet feeding device 20 supplies paper sheets P to the image forming unit 10. The sheet feeding device 20 includes plural sheet trays that store paper sheets P of different types (for example, different materials, thicknesses, sizes, or grain directions), and is configured to supply a paper sheet P fed from one of the sheet trays to the image forming unit 10.

The sheet discharge unit 30 discharges a recording medium on which an image is formed by the image forming unit 10. Accordingly, the sheet discharge unit 30 includes a paper receiving portion that receives the recording medium discharged after the image is formed thereon. The sheet discharge unit 30 may have a function of performing post-processing, such as cutting or stapling (staple binding), on a stack of paper sheets discharged from the image forming unit 10.

The operation display 40 is used to input various settings and instructions and display information. The operation display 40 corresponds to a user interface, and is obtained by combining, for example, a liquid crystal display panel, various operation buttons, and a touch panel together.

(1.2) Structure and Operation of Image Forming Unit

In the image forming apparatus 1 having the above-described structure, a paper sheet P fed from one of the sheet trays of the sheet feeding device 20 that is specified for each sheet of a print job is transported to the image forming unit 10 in accordance with the timing of an image forming operation.

The photoconductor units 13 include photoconductor drums 31 that are arranged parallel to each other below the exposure devices 12 and that serve as rotatable image carriers. Each photoconductor drum 31 is surrounded by a charging device 32, an exposure device 12, a developing device 14, a first transfer roller 52, and a cleaning blade 34, which arranged around in that order in the rotation direction of the photoconductor drum 31.

Each developing device 14 includes a developing housing 41 containing developer. A developing roller 42, which opposes the corresponding photoconductor drum 31, is disposed in the developing housing 41. The developing roller 42 has a developer layer with a regulated thickness provided thereon, and forms a toner image on the photoconductor drum 31.

The developing devices 14 have substantially the same structures except for the developers contained in the developing housings 41 thereof, and form toner images in yellow (Y), magenta (M), cyan (C), black (K), white (W), and silver (S), which is a special color.

Replaceable toner cartridges T that contain developers (toners containing carriers) are disposed above the developing devices 14. Toner cartridge guides TG are arranged to supply the developers from the toner cartridges T to the developing devices 14.

The surfaces of the photoconductor drums 31 that rotate are charged by the respective charging devices 32, and electrostatic latent images are formed thereon by latent-image-forming light emitted from the respective exposure devices 12. The electrostatic latent images formed on the photoconductor drums 31 are developed into toner images by the respective developing rollers 42.

The transfer device 15 includes an intermediate transfer belt 51, first transfer rollers 52, and a second transfer belt 53. The intermediate transfer belt 51 serves as an image carrier to which the toner images of the respective colors formed on the photoconductor drums 31 of the photoconductor units 13 are transferred in a superposed manner. The first transfer rollers 52 successively transfer the toner images of the respective colors formed by the photoconductor units 13 to the intermediate transfer belt 51 (first transfer process). The second transfer belt 53 serves as a transfer member that simultaneously transfers the toner images of the respective colors superposed on the intermediate transfer belt 51 to a paper sheet that serves as a recording medium (second transfer process).

The second transfer belt 53 is wound around a second transfer roller 54 and a separation roller 55, and is nipped between a backup roller 65, which is disposed on the inner side of the intermediate transfer belt 51, and the second transfer roller 54 to form a second transfer unit TR.

The toner images of the respective colors formed on the photoconductor drums 31 of the photoconductor units 13 are successively electrostatically transferred to the intermediate transfer belt 51 by the first transfer rollers 52 to which a predetermined transfer voltage is applied by, for example, a power supply (not shown) controlled by the system control device 11 (first transfer process). Thus, a superposed toner image in which the toner images of the respective colors are superposed is formed.

The intermediate transfer belt 51 is moved so that the superposed toner image on the intermediate transfer belt 51 is transported to the second transfer unit TR at which the second transfer belt 53 is disposed. When the superposed toner image is transported to the second transfer unit TR, the paper sheet P is supplied to the second transfer unit TR from the sheet feeding device 20 at the same time. The backup roller 65 opposes the second transfer roller 54, which is grounded, with the second transfer belt 53 provided between. A power supply or the like controlled by the system control device 11 applies a predetermined transfer voltage to the backup roller 65 through a power feed roller 65A. Thus, the toner images superposed on the intermediate transfer belt 51 are simultaneously transferred to the paper sheet P.

The toner that remains on the surface of each photoconductor drum 31 is removed by the corresponding cleaning blade 34 and is collected in a waste toner container (not shown). The surface of each photoconductor drum 31 is charged again by the corresponding charging device 32.

The fixing device 17 includes an endless fixing belt 17*a* that rotates in one direction and a pressing roller 17*b* that is in contact with the peripheral surface of the fixing belt 17*a* and that rotates in one direction. The region in which the fixing belt 17*a* and the pressing roller 17*b* are pressed against each other serves as a nip portion (fixing region).

The paper sheet P to which the toner images have been transferred by the transfer device 15 is transported to the fixing device 17 by the sheet transporting device 16*a* while the toner images are unfixed. The recording medium transported to the fixing device 17 is pressed and heated by the fixing belt 17*a* and the pressing roller 17*b*, so that the toner images are fixed thereto.

After the fixing process, the paper sheet P is transported to the sheet discharge unit 30 by the sheet transporting device 16*b*.

When images are to be formed on both sides of the paper sheet P, the paper sheet P is reversed by the sheet transporting device 16*c*, and is transported to the second transfer unit TR of the image forming unit 10 again. Then, after toner images are transferred to the paper sheet P and the transferred images are fixed, the paper sheet P is transported to the sheet discharge unit 30. The paper sheet P transported to the sheet discharge unit 30 is subjected to post-processing, such as cutting or stapling (stable bonding), as necessary, and is discharged to the paper receiving portion.

Figure 3:
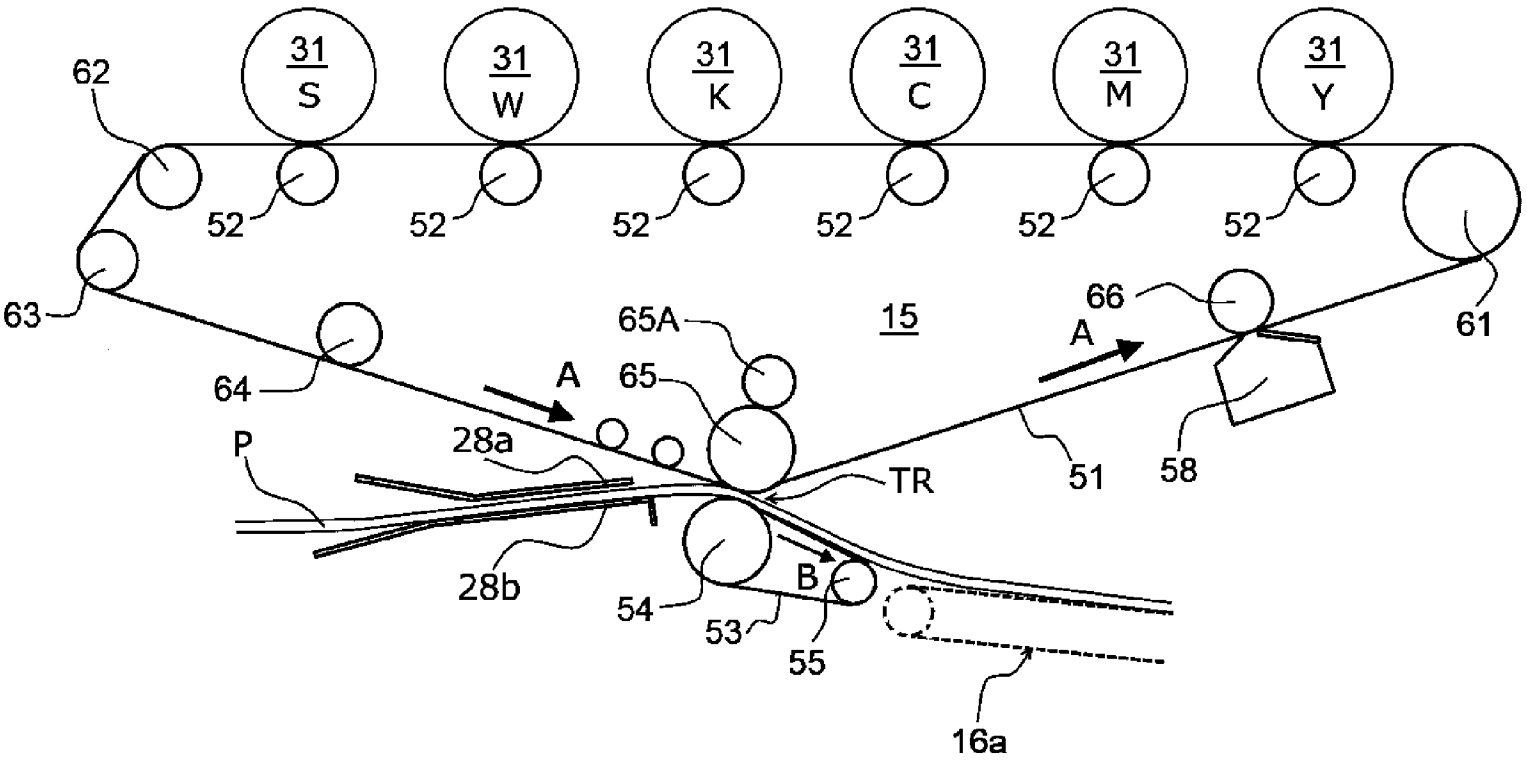
FIG. 3 is a schematic sectional view illustrating the structure of a transfer device included in the image forming apparatus according to the first exemplary embodiment.
Figure 4:
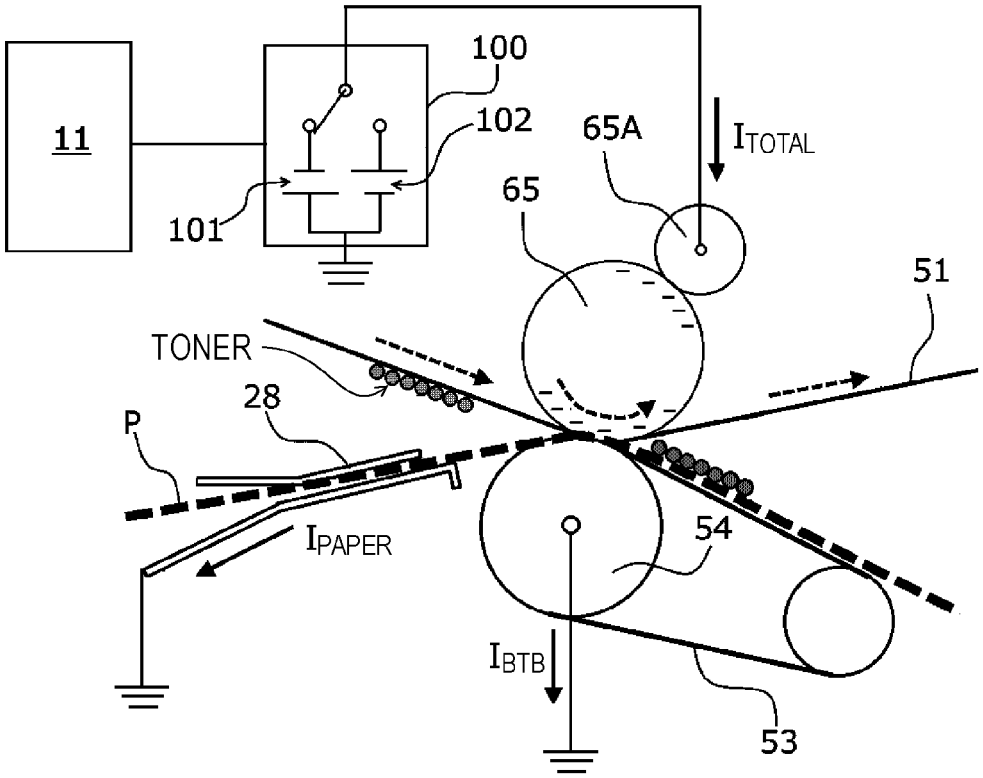
FIG. 4 illustrates a structure for applying a transfer bias in a second transfer unit of the image forming apparatus according to the first exemplary embodiment.
Figure 5:
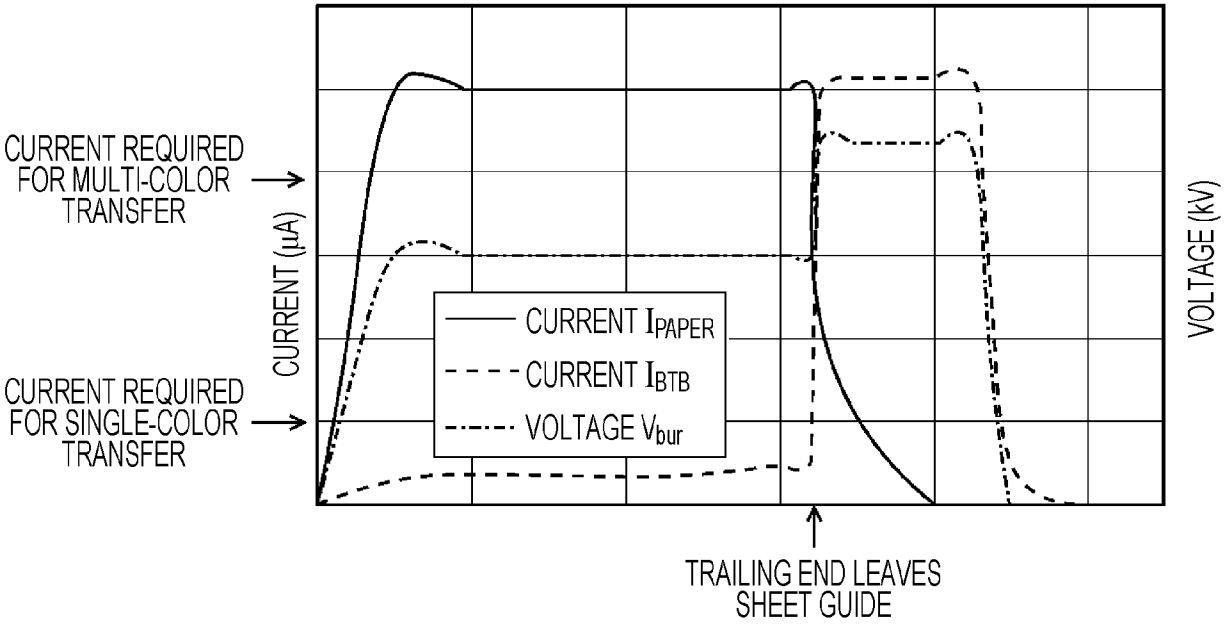
FIG. 5 is a graph showing an example of a transfer current and a transfer electric field along a sheet transporting direction during a second transfer process performed on low resistance paper in the image forming apparatus according to the first exemplary embodiment.
Figure 11A:
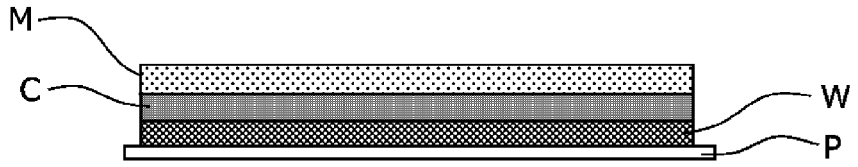
FIGS. 11A and 11B illustrate a first image defect to be prevented by the present invention.
Figure 11B:
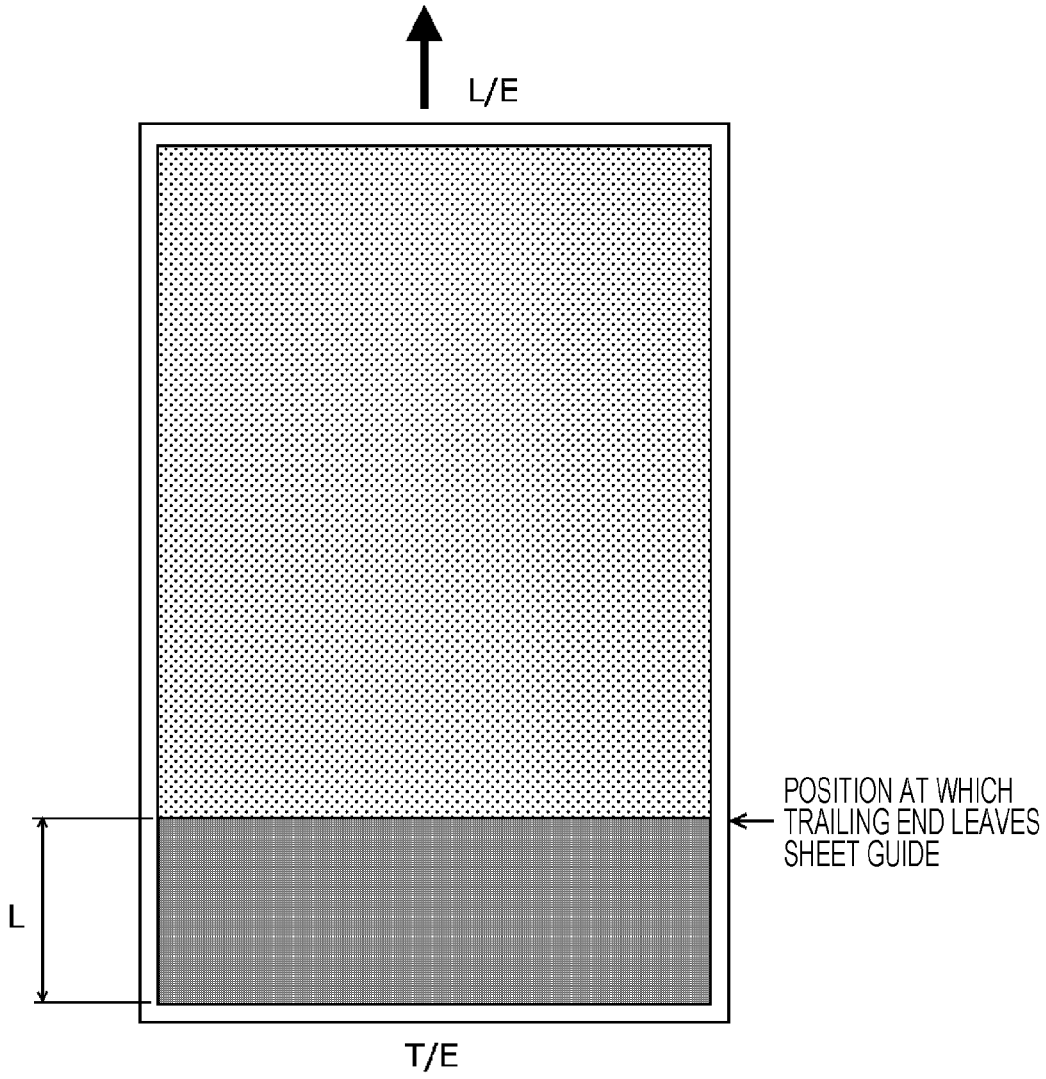

(2) Structure and Operation of Transfer Device (2.1) Structure of Transfer Device FIG. 3 is a schematic sectional view illustrating the structure of the transfer device 15 included in the image forming apparatus 1 according to the present exemplary embodiment. FIG. 4 illustrates a structure for applying a transfer bias in the second transfer unit TR of the image forming apparatus 1. FIG. 5 is a graph showing an example of a transfer current and a transfer electric field along a transporting direction of the paper sheet P during the second transfer process performed on low resistance paper. FIGS. 11A and 11B illustrate a first image defect to be prevented by the present invention.

The transfer device 15 includes the intermediate transfer belt 51, the first transfer rollers 52, the second transfer belt 53, the backup roller 65, the second transfer roller 54, and a cleaning unit 58.

The intermediate transfer belt 51 is made of a resin, such as polyimide or polyamide imide, in which an appropriate amount of conductive agent, such as carbon black, is contained so that the volume resistivity thereof is 1E+10 to 1E+14 Ω·cm. The intermediate transfer belt 51 is a film-shaped endless belt having a thickness of, for example, about 0.1 mm.

The intermediate transfer belt 51 rotates (see arrow A in FIG. 3) while being wound around a driving roller 61 that rotates the intermediate transfer belt 51; a driven roller 62 that supports a portion of the intermediate transfer belt 51 that extends substantially linearly in the direction in which the photoconductor drums 31 are arranged; a tension roller 63 that applies a certain tension to the intermediate transfer belt 51 to prevent snaking of the intermediate transfer belt 51; a support roller 64 that is disposed upstream of the second transfer unit TR and supports the intermediate transfer belt 51; a backup roller 65 provided at the second transfer unit TR; and a cleaning backup roller 66 disposed near the cleaning unit 58 that scrapes off the toner that remains on the intermediate transfer belt 51.

The backup roller 65 includes a tube made of a blended rubber of EPDM and NBR having a surface over which carbon is dispersed, and an inner portion made of EPDM rubber. The backup roller 65 has a surface resistivity of 1E+7 to 1E+10 Ω/sq., a roller diameter of 28 mm, and an Asker-C hardness of, for example, 70 degrees.

The backup roller 65 is disposed on the inner side of the intermediate transfer belt 51 and serves as an opposing electrode for the second transfer belt 53. The backup roller 65 is in contact with the power feed roller 65A, which is made of a metal. The power feed roller 65A applies a direct current (DC) voltage for forming a second transfer electric field in the second transfer unit TR.

Each of the first transfer rollers 52 opposes the corresponding photoconductor drum 31 with the intermediate transfer belt 51 disposed therebetween, and receives a voltage having a polarity that is opposite to the charge polarity of the toner. Accordingly, the toner images on the photoconductor drums 31 are successively electrostatically attracted to the intermediate transfer belt 51, and are thereby superposed on the intermediate transfer belt 51.

The second transfer belt 53 is, for example, a semiconductive endless-loop-shaped belt formed of a rubber material, such as chloroprene or EPDM, in which an appropriate amount of conductive agent, such as carbon black, is contained so that the volume resistivity thereof is adjusted to, for example, 1E+6 to 1E+10 Ω·cm.

As illustrated in FIG. 3, the second transfer belt 53 is wound around the second transfer roller 54 and the separation roller 55, and a predetermined tension is applied thereto. In the present exemplary embodiment, the second transfer belt 53 receives a driving force from the second transfer roller 54 and rotates at a predetermined speed (see arrow B in FIG. 3).

The second transfer roller 54 includes a metal shaft that serves as a core and a conductive layer provided on the outer periphery of the core. The conductive layer is composed of a foamed body of, for example, silicone rubber, urethane rubber, or EPDM in which a conductive agent, such as carbon black, is dispersed. The second transfer roller 54 opposes the backup roller 65 with the second transfer belt 53 and the intermediate transfer belt 51 disposed therebetween.

The second transfer roller 54, which is electrically grounded, forms the second transfer unit TR together with the backup roller 65. The second transfer unit TR transfers the toner image on the intermediate transfer belt 51 to the paper sheet P transported by the second transfer belt 53 in the second transfer process.

The second transfer roller 54 is connected to a driving motor (not shown), and is rotated by the driving motor. Also, the second transfer roller 54 rotates the second transfer belt 53.

As illustrated in FIG. 3, the separation roller 55 is disposed downstream of the second transfer roller 54 in the rotation direction of the second transfer belt 53 (direction of arrow B in FIG. 3). The separation roller 55 and the second transfer roller 54 form a belt surface that transports the paper sheet P downstream.

The separation roller 55 has a roller diameter smaller than that of the second transfer roller 54 to facilitate separation of the paper sheet P from the surface of the second transfer belt 53.

A sheet guide 28, which is an example of a guide unit that guides the paper sheet P to the second transfer unit TR, is disposed upstream of the second transfer unit TR of the transfer device 15. The sheet guide 28 opposes the surface of the intermediate transfer belt 51 that carries the toner image.

The sheet guide 28 includes a sheet guide 28*a* that guides the upper surface (transfer surface) of the paper sheet P and a sheet guide 28*b* that guides the lower surface (non-transfer surface) of the paper sheet P.

(2.2) Bias Application Control of Transfer Device

As illustrated in FIG. 4, the backup roller 65 is connected to a transfer bias power supply 100 that applies a DC voltage to the power feed roller 65A for applying the transfer bias.

The transfer bias power supply 100 includes a transfer bias power supply 101 and a cleaning bias power supply 102 having different polarities, and switches the state of connection with respect to the power feed roller 65A depending on whether or not the second transfer process is performed.

For example, when the second transfer process is performed to transfer a toner image TN on the intermediate transfer belt 51 to the paper sheet P transported from the sheet feeding device 20 to the second transfer unit TR through the sheet guide 28 (see FIG. 3), the transfer bias power supply 101 applies a DC bias voltage Vbur to the power feed roller 65A. The DC bias voltage Vbur is controlled so that a predetermined transfer current $I_{TOTAL}$ is supplied.

When the second transfer process for transferring a toner image to the paper sheet P is not performed, for example, when a cleaning process is performed, the cleaning bias power supply 102 applies a cleaning bias Vcln to the power feed roller 65A. As a result, a potential difference is generated between the intermediate transfer belt 51 and the second transfer belt 53 so that unnecessary toner on the second transfer belt 53 is electrostatically attracted to the intermediate transfer belt 51 and collected by the cleaning unit 58 (see FIG. 3).

When a sheet of low resistance paper whose surface resistance is lower than that of normal paper (for example, metallic aluminized paper or black paper containing carbon black having a surface resistivity of 1E+6 Ω/sq. or less, or approximately 1E+6 Ω/sq. or less) is used as the paper sheet P, there is a risk that a difference in toner density will occur in a transporting direction in which the paper sheet P is transported.

More specifically, as illustrated in FIGS. 11A and 11B, there is a risk that the density will drop in a rear region of the paper sheet P in the transporting direction over a length corresponding to a distance L from the second transfer unit TR to the position at which the trailing end T/E of the paper sheet P leaves the sheet guide 28. In particular, when magenta (M) toner and cyan (C) toner are transferred onto a white toner image WT formed on a low resistance paper sheet, there is a risk that a large density difference will occur due to reduction in transferability of the magenta (M) toner and the cyan (C) toner.

When the DC bias voltage Vbur is applied to transfer the toners to a low resistance paper sheet, the system resistance of route RT2 (route through the backup roller 65, the intermediate transfer belt 51, the paper sheet P, and GND of the sheet guide 28) is lower than that of route RT1 (route through the backup roller 65, the intermediate transfer belt 51, the paper sheet P, and the second transfer belt 53). Therefore, the amount of current $I_{PAPER}$ that flows along route RT2 is greater than the amount of current $I_{BTB}$ that flows along route RT1, and the toners are transferred by the electric field produced by the current $I_{PAPER}$.

Figure 12:
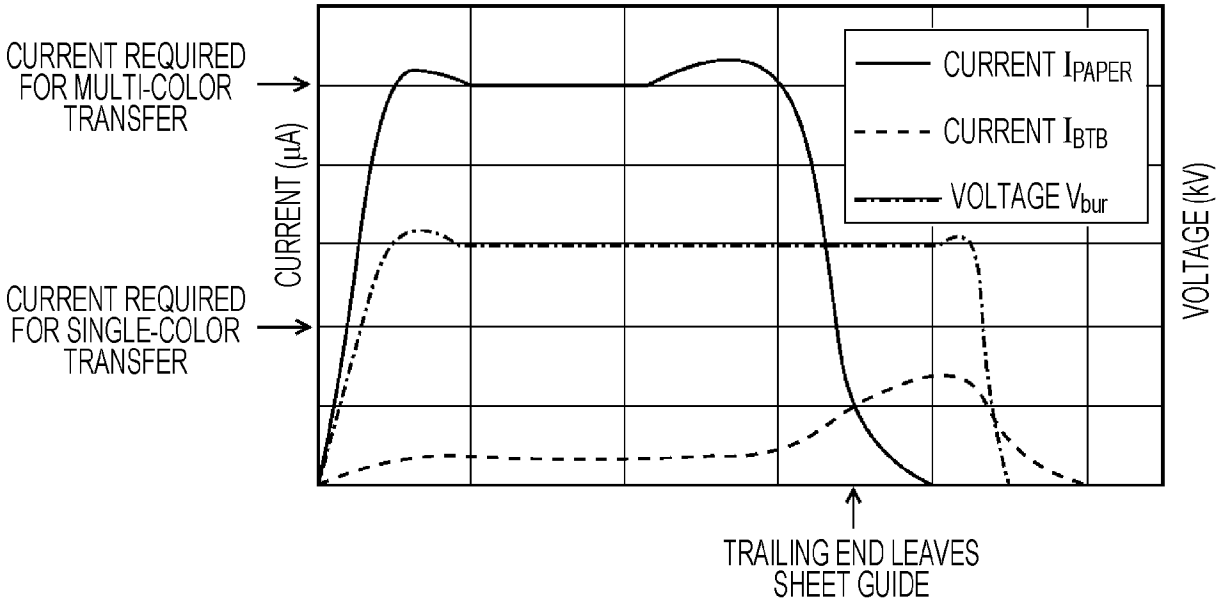
FIG. 12 is a graph showing an example of a transfer current and a transfer electric field along a sheet transporting direction when the first image defect occurs during a second transfer process.

The transfer bias power supply 101 is controlled to output a constant voltage. When a low resistance paper sheet is used, the toners are transferred to the low resistance paper sheet by using route RT2 for a major part thereof, and therefore the DC bias voltage Vbur is set to an optimum voltage based on route RT2. As is clear from FIG. 12, route RT1 is used after the trailing end T/L of the low resistance paper sheet leaves the sheet guide 28. Since the DC bias voltage Vbur is set to the optimum voltage based on route RT2 whose system resistance is lower than that of route RT1, a sufficiently strong electric field cannot be generated when route RT1 having a high system resistance is used. Accordingly, transfer failure may occur in the rear region of the paper sheet P in the transporting direction over a length corresponding to the distance L from the second transfer unit TR to the position at which the trailing end T/E of the paper sheet P leaves the sheet guide 28. This is probably the cause of a density difference in the transporting direction of the paper sheet P.

In the image forming apparatus 1 according to the present exemplary embodiment, when the paper sheet P is a sheet of low resistance paper, such as metallic paper including a metal layer on the surface thereof or black paper containing carbon, and has a surface resistivity of 1E+6 Ω/sq. or less, or approximately 1E+6 Ω/sq. or less, the system control device 11 sets the DC bias voltage Vbur so that the transfer current applied to the power feed roller 65A is within a predetermined range at the time when the paper sheet P becomes separated from the sheet guide 28.

More specifically, as illustrated in FIG. 5, the DC bias voltage Vbur is increased so that the amount of current $I_{BTB}$ that flows along route RT1 is as large as the amount of transfer current $I_{PAPER}$ that flows along route RT2 when the paper sheet P is in contact with the sheet guide 28. Thus, even when a low resistance paper sheet is used, the difference in density of the toner image in the transporting direction of the paper sheet P may be reduced.

The amount of increase in the DC bias voltage Vbur may be increased as the volume resistivity of the paper sheet P increases. Accordingly, even when the paper sheet P is thick, the difference in density of the toner image in the transporting direction of the paper sheet P may be reduced.

Second Exemplary Embodiment

Figure 6:
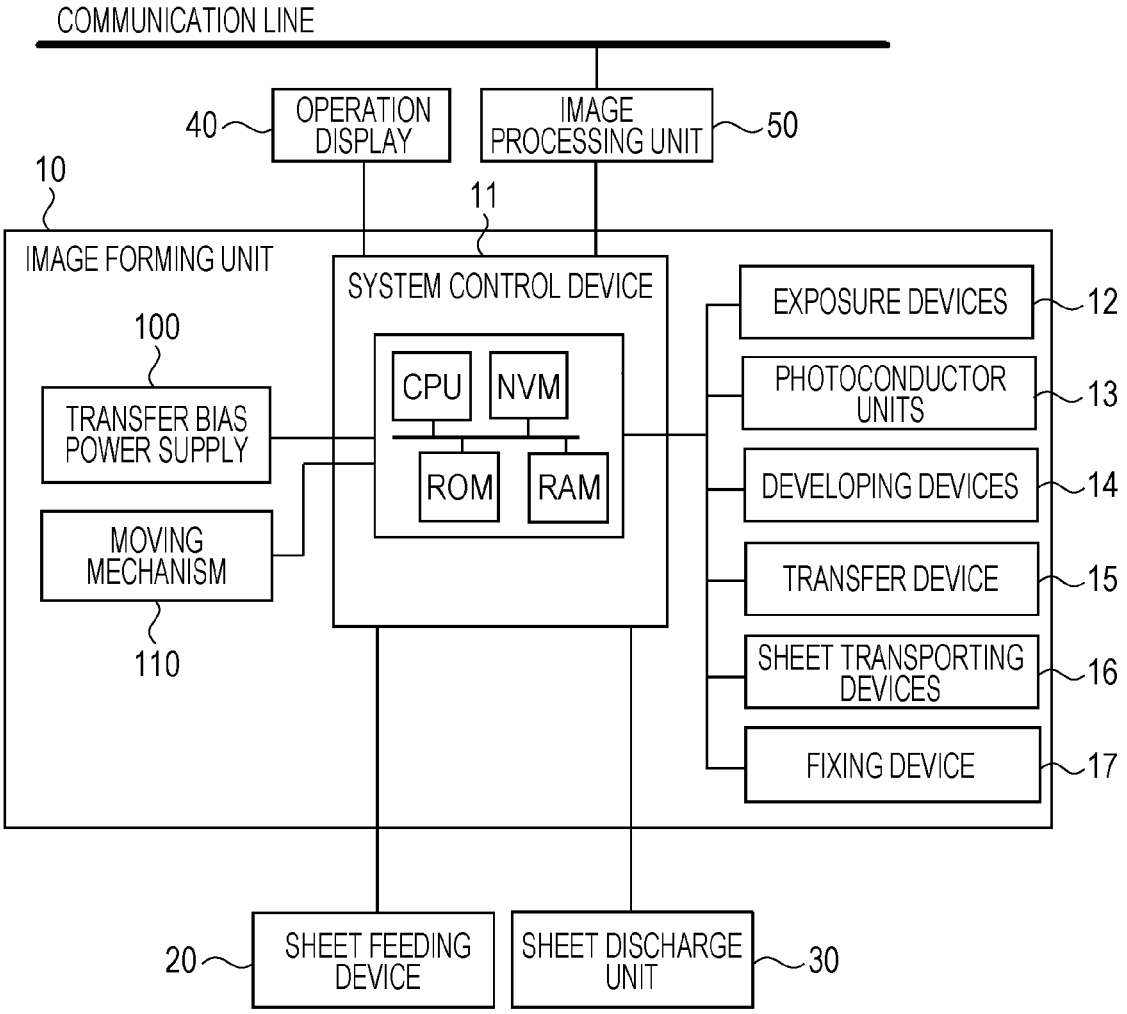
FIG. 6 is a block diagram illustrating the functional configuration of an image forming apparatus according to a second exemplary embodiment.
Figure 7:
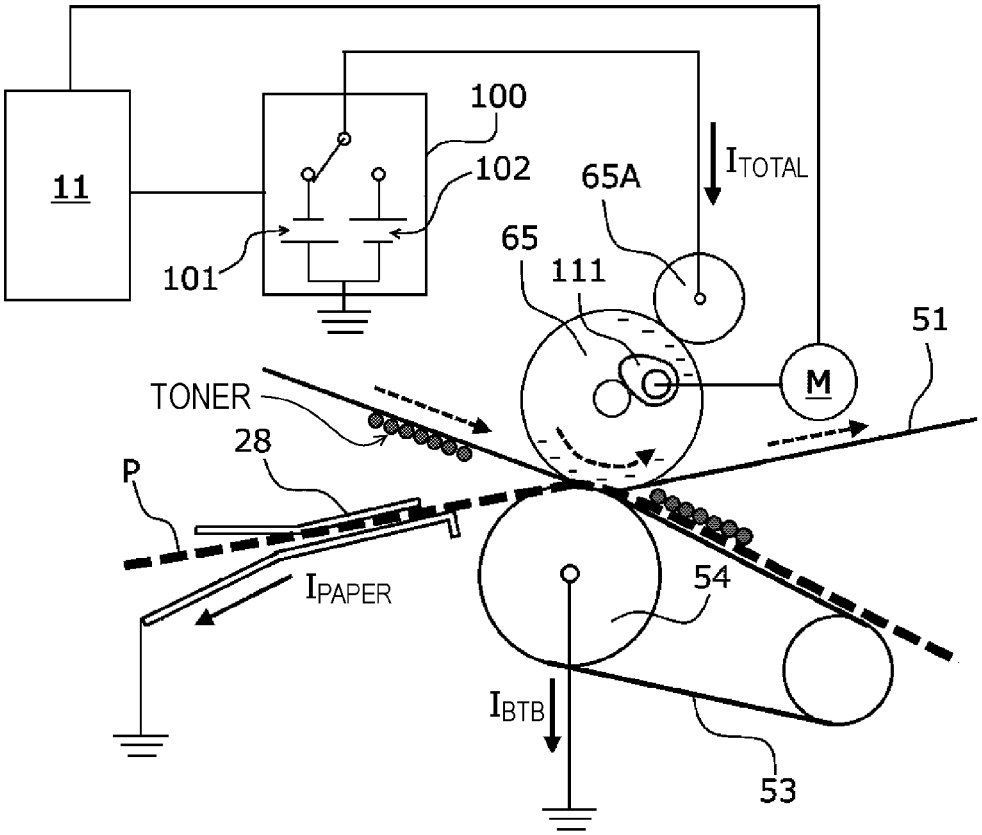
FIG. 7 illustrates a structure for applying a transfer bias and an adjustment of a transfer nip in a second transfer unit of the image forming apparatus according to the second exemplary embodiment.
Figure 8:
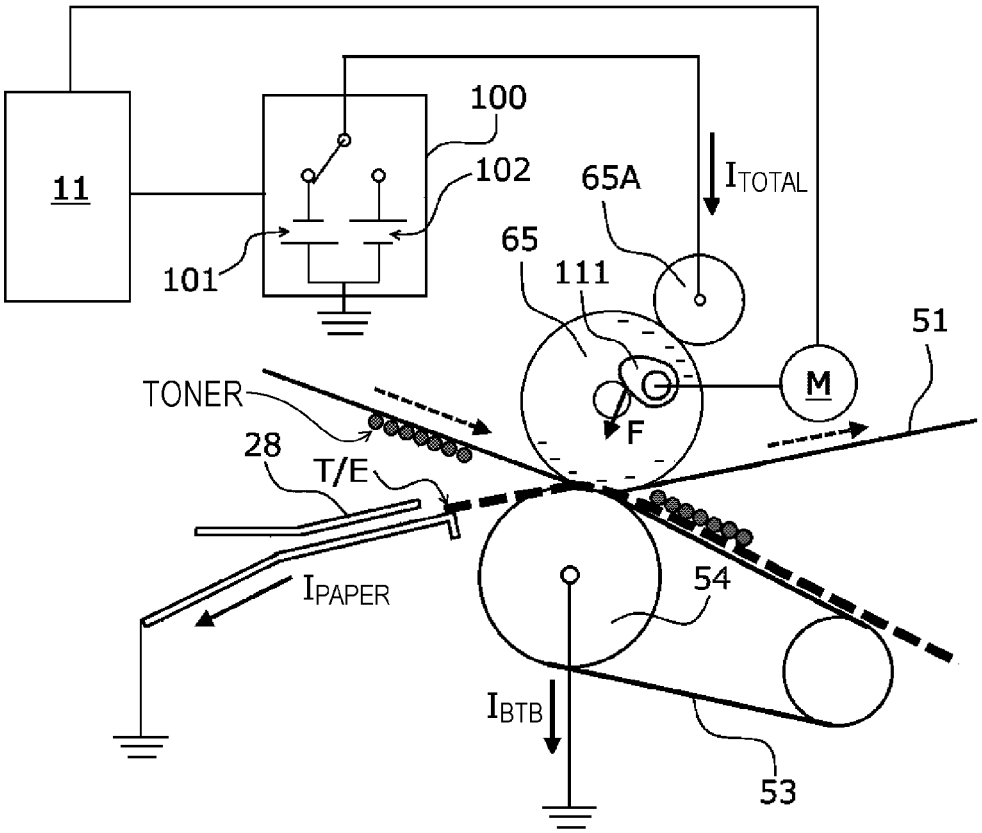
FIG. 8 illustrates the way in which the transfer nip is adjusted in the second transfer unit of the image forming apparatus according to the second exemplary embodiment.
Figure 9:
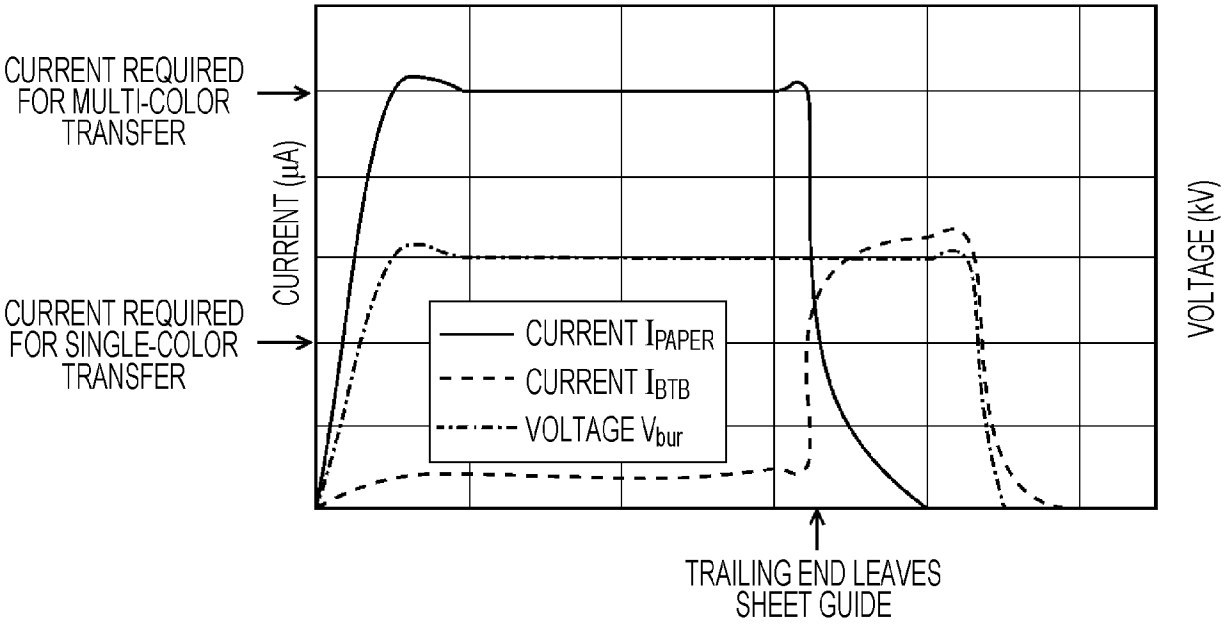
FIG. 9 is a graph showing an example of a transfer current and a transfer electric field along a sheet transporting direction during a second transfer process performed on low resistance paper in the image forming apparatus according to the second exemplary embodiment.

FIG. 6 is a block diagram illustrating the functional configuration of an image forming apparatus according to a second exemplary embodiment. FIG. 7 illustrates a structure for applying a transfer bias and an adjustment of a transfer nip in a second transfer unit TR of the image forming apparatus according to the second exemplary embodiment. FIG. 8 illustrates the way in which the transfer nip is adjusted in the second transfer unit TR of the image forming apparatus according to the second exemplary embodiment. FIG. 9 is a graph showing an example of a transfer current and a transfer electric field along the transporting direction of the paper sheet P during the second transfer process performed on low resistance paper.

The image forming apparatus according to the present exemplary embodiment differs from the image forming apparatus 1 according to the first exemplary embodiment in that a moving mechanism 110 is provided to move the backup roller 65 in the normal direction in which the backup roller 65 and the second transfer roller 54 oppose each other. Accordingly, components that are the same as those in the image forming apparatus 1 according to the first exemplary embodiment are denoted by the same reference numerals.

As illustrated in FIG. 6, the image forming apparatus according to the present exemplary embodiment includes the moving mechanism 110 that moves the backup roller 65 in the normal direction in which the backup roller 65 and the second transfer roller 54 oppose each other.

Referring to FIG. 7, the moving mechanism 110 includes an eccentric cam 111 and a rotary actuator M that rotates the eccentric cam 111. When the paper sheet P is transported, the system control device 11 moves the backup roller 65 so as to increase or reduce the pressing force applied to the paper sheet P in the second transfer unit TR, thereby increasing or reducing the center-to-center distance between the backup roller 65 and the second transfer roller 54.

In the image forming apparatus according to the present exemplary embodiment, when the paper sheet P is a sheet of low resistance paper, such as metallic paper including a metal layer on the surface thereof or black paper containing carbon, and has a surface resistivity of 1E+6 Ω/sq. or less, or approximately 1E+6 Ω/sq. or less, the system control device 11 sets the pressing force applied to the paper sheet P so that the pressing force is greater when the paper sheet P is not in contact with the sheet guide 28 than when the paper sheet P is in contact with the sheet guide 28.

More specifically, as illustrated in FIG. 8, when the trailing end T/E of the paper sheet P leaves the sheet guide 28, the eccentric cam 111 is rotated (see arrow F in FIG. 8) to reduce the center-to-center distance between the backup roller 65 and the second transfer roller 54, thereby enhancing the second transfer nip in the second transfer unit TR.

When the backup roller 65 and the second transfer roller 54 are indented with the intermediate transfer belt 51 and the second transfer belt 53 disposed therebetween, that is, when the center-to-center distance between the second transfer roller 54 and the backup roller 65 is smaller than the sum of the radii of the second transfer roller 54 and the backup roller 65, the backup roller 65, the intermediate transfer belt 51, the paper sheet P, the second transfer belt 53, and the second transfer roller 54 are reliably in contact with each other in the second transfer unit TR, so that the system resistance of route RT1 is reduced. Accordingly, as illustrated in FIG. 9, even when the DC bias voltage Vbur is constant, a relatively strong transfer electric field may be obtained.

As a result, even when a low resistance paper sheet is used, the difference in density of the toner image in the transporting direction of the paper sheet P may be reduced.

Third Exemplary Embodiment

Figure 13:
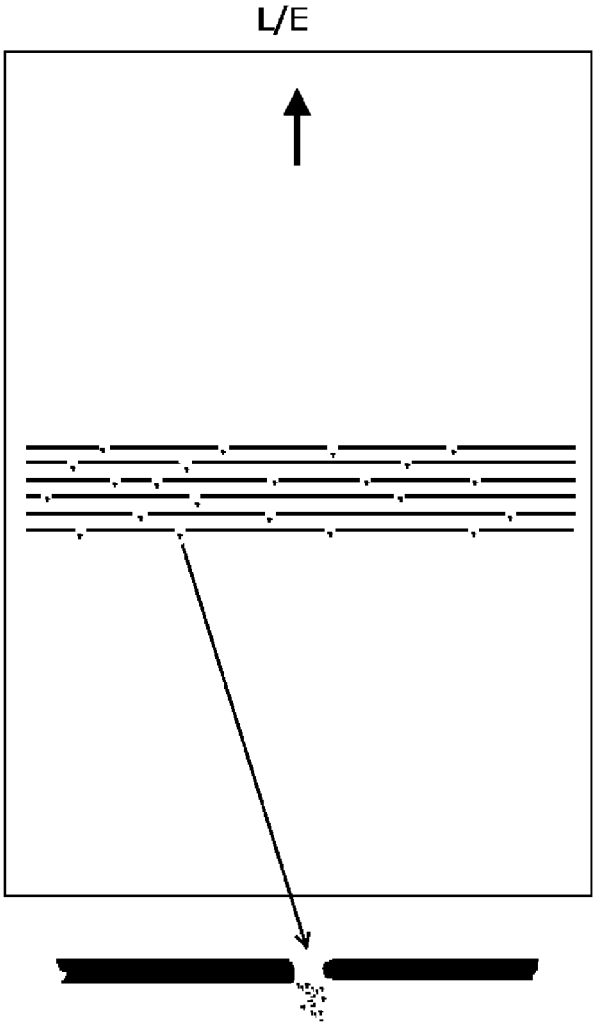
FIG. 13 illustrates an example of a second image defect to be prevented by the present invention.
Figure 14:
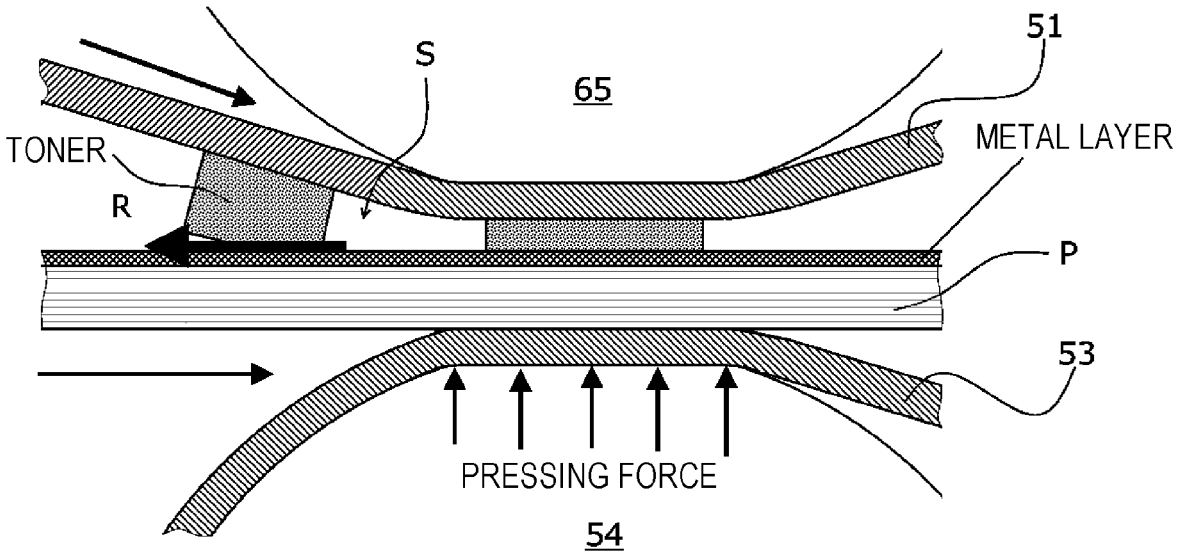
FIG. 14 illustrates a probable cause of the second image defect to be prevented by the present invention.
Figure 15:
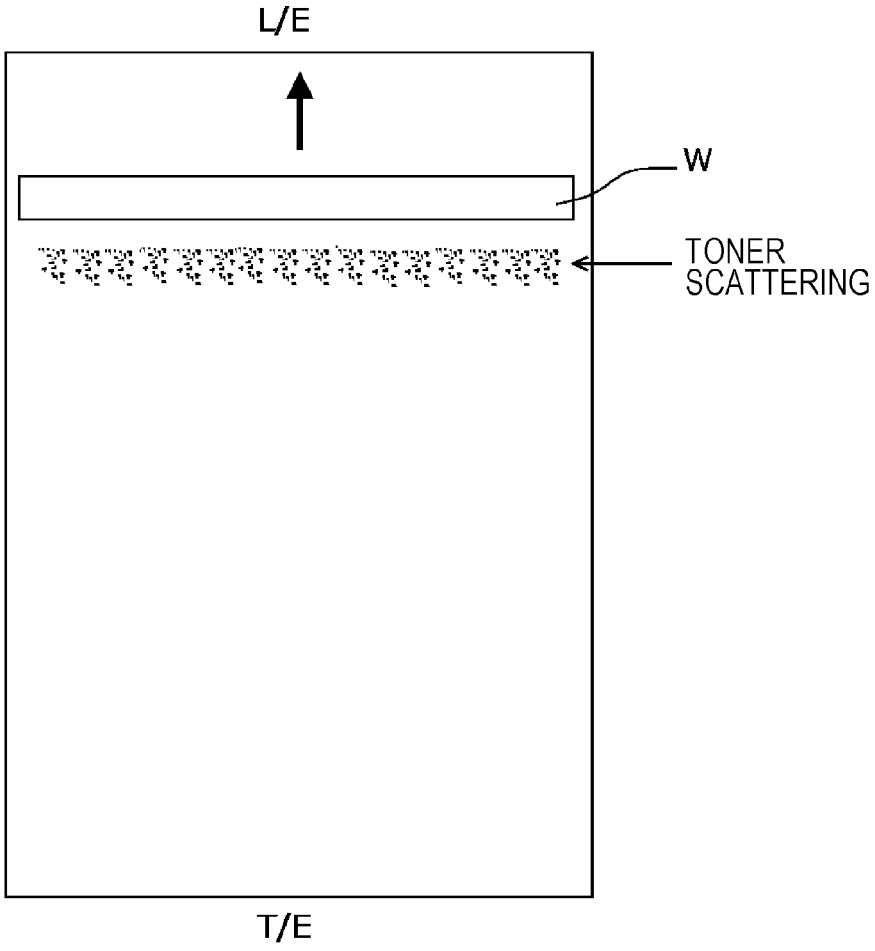
FIG. 15 illustrates an example of a third image defect to be prevented by the present invention.
Figure 16:
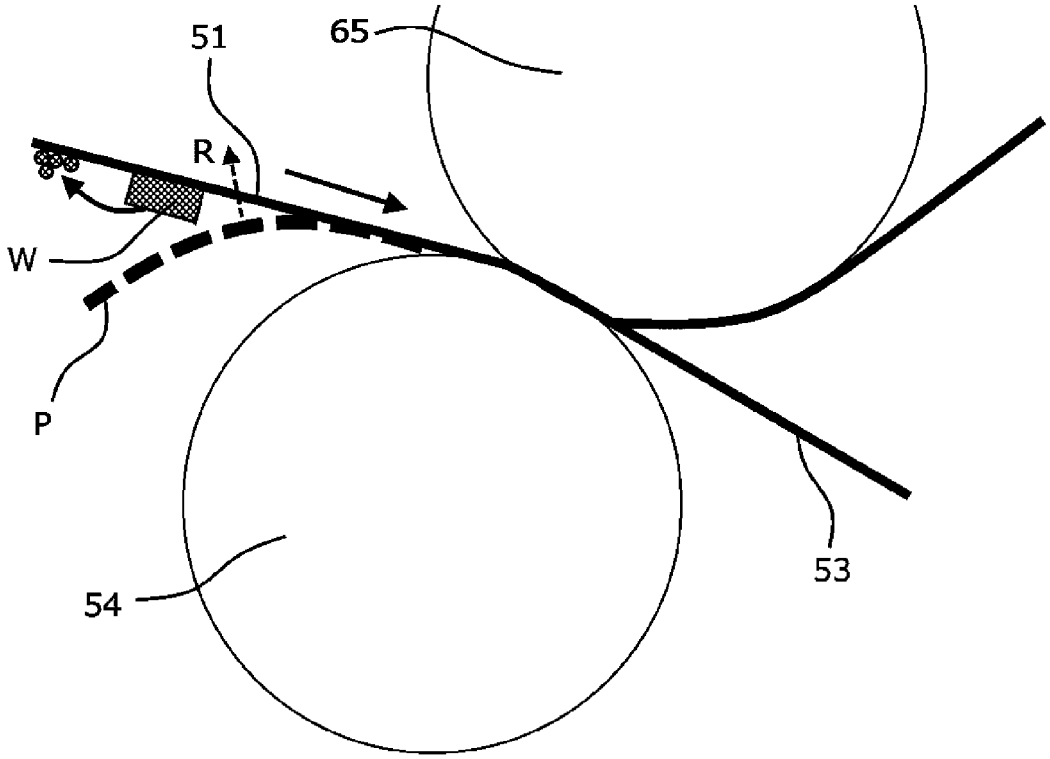
FIG. 16 illustrates a probable cause of the third image defect to be prevented by the present invention.
Figure 17:
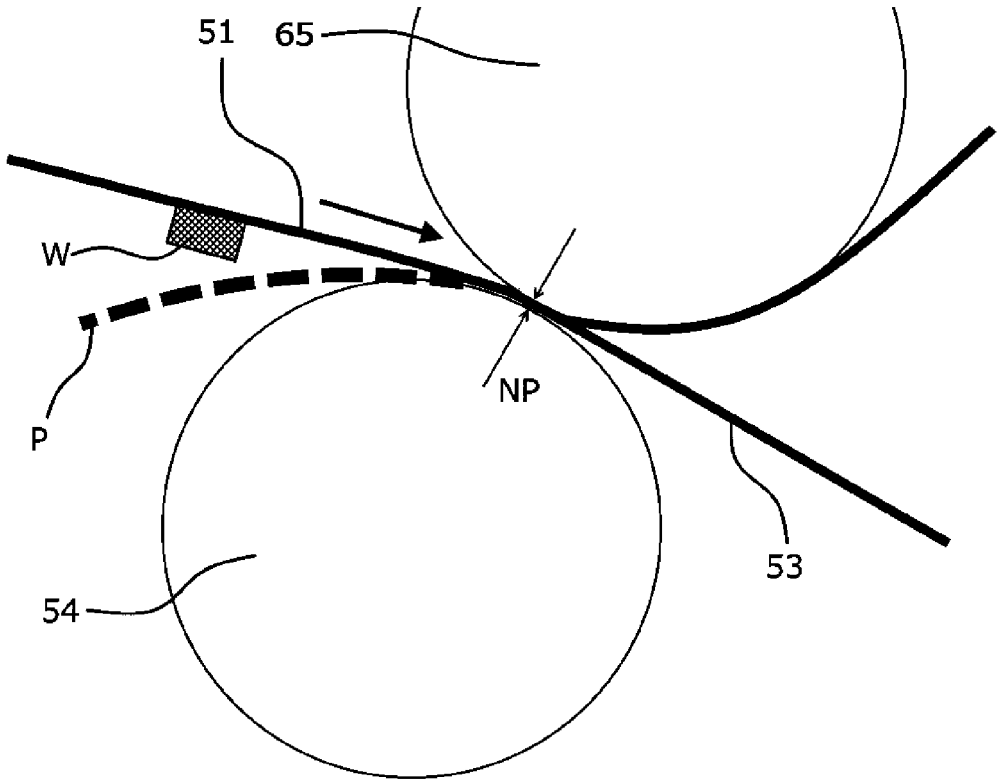
FIG. 17 illustrates the way in which a transfer nip is adjusted in a second transfer unit of an image forming apparatus according to a third exemplary embodiment.

FIG. 13 illustrates an example of a second image defect to be prevented by the present invention. FIG. 14 illustrates a probable cause of the second image defect to be prevented by the present invention. FIG. 15 illustrates an example of a third image defect to be prevented by the present invention. FIG. 16 illustrates a probable cause of the third image defect to be prevented by the present invention. FIG. 17 illustrates the way in which a transfer nip is adjusted in a second transfer unit TR of an image forming apparatus according to a third exemplary embodiment.

When the paper sheet P that is used is a sheet of metallic paper including a metal layer on the surface thereof, an image defect may occur due to toner scattered rearward, that is, in a direction opposite to the traveling direction, from a portion of the intermediate transfer belt 51 that is immediately in front of the region in which the second transfer roller 54 and the backup roller 65 are strongly pressed against each other in the second transfer unit TR (see FIG. 13). Such an image defect easily occurs when the toner image to be formed includes plural thin lines extending in a direction orthogonal to the transporting direction of the paper sheet P.

As illustrated in FIG. 14, the intermediate transfer belt 51 and the paper sheet P are stacked together and the back surface of the paper sheet P comes into contact with the second transfer belt 53 in a pre-nip region of the second transfer unit TR. At this time, the toner on the intermediate transfer belt 51 is sandwiched between the intermediate transfer belt 51 and the paper sheet P, and a space S is formed between the toner that forms a line in a region in front thereof and the toner that forms a line in a region therebehind.

When this space S enters the region in which the second transfer roller 54 and the backup roller 65 are strongly pressed against each other in the second transfer unit TR, the space S is squashed from the front side thereof by a large pressing force. When, for example, the image includes plural thin lines extending in the direction orthogonal to the traveling direction of the paper sheet P, the air in the space S is trapped, and discharge paths for the air cannot be easily formed.

Therefore, when the space S is squashed from the front side thereof, toner particles that form a thin line in the region behind the space S where the pressing force is weak are blown by the air pressure as shown by arrow R in FIG. 14. Thus, the air in the space S are discharged rearward. This is probably the cause of rearward scattering of the toner that forms the thin line in the region behind the space S.

In addition, when metallic paper is used, the metal layer on the surface of the metallic paper serves as an electrode that forms an electric field in the pre-nip region, and the adhesion between the intermediate transfer belt 51 and the toner layer is reduced. Therefore, it is presumed that the toner that forms the thin line in the region behind the space S cannot easily withstand the air pressure, and is more easily scattered rearward.

When the toner image is formed of white (W) toner or silver (S) toner, an image defect may occur due to toner scattered rearward, that is, in a direction opposite to the transporting direction, in a region near the leading end L/E of the paper sheet P (see FIG. 15).

When the leading end L/E of the paper sheet P enters the second transfer unit TR, the paper sheet P comes into contact with the transfer nip in such a manner that a leading end portion thereof comes into contact with the intermediate transfer belt 51 in a bent state (see arrow R in FIG. 16). As a result, the intermediate transfer belt 51 vibrates, and the toner on the intermediate transfer belt 51 is scattered before the second transfer process (see FIG. 16).

In particular, white (W) toner and silver (S) toner have large masses because they contain metal pigments, and therefore receive a large force as a result of the vibration of the intermediate transfer belt 51. Accordingly, it is presumed that these toners easily scatter.

In the image forming apparatus according to the present exemplary embodiment, when the paper sheet P is a sheet of low resistance paper, such as metallic paper including a metal layer on the surface thereof or black paper containing carbon, and has a surface resistivity of 1E+6 Ω/sq. or less, or approximately 1E+6 Ω/sq. or less, the system control device 11 controls the moving mechanism 110 so that a center-to-center distance L1 between the backup roller 65 and the second transfer roller 54 is greater than the sum of a radius R1 of the backup roller 65 and a radius R2 of the second transfer roller 54 when the paper sheet P is in contact with the sheet guide 28 and that the center-to-center distance L1 between the backup roller 65 and the second transfer roller 54 is reduced when the paper sheet P is not in contact with the sheet guide 28.

More specifically, as illustrated in FIG. 17, the amount of indentation in a transfer nip NP of the second transfer unit TR is set to a negative value (the backup roller 65 and the second transfer roller 54 are not pressed against each other) when the paper sheet P is not in contact with the sheet guide 28. When the trailing end T/E of the paper sheet P leaves the sheet guide 28, the eccentric cam 111 is rotated (see arrow F in FIG. 8) to reduce the center-to-center distance L1 between the backup roller 65 and the second transfer roller 54, thereby enhancing the second transfer nip in the second transfer unit TR.

Thus, the amount by which the paper sheet P that enters the second transfer unit TR is bent toward the intermediate transfer belt 51 is reduced. Accordingly, when white (W) toner or silver (S) toner is used, image defects that occur in the region near the leading end L/E of the paper sheet P due to toner scattered rearward, that is, in the direction opposite to the transporting direction, may be reduced.

In addition, the pressing force applied to the paper sheet P in the second transfer unit TR when the paper sheet P is in contact with the sheet guide 28 is reduced, so that image defects due to toner scattered rearward, that is, in the direction opposite to the transporting direction, from the intermediate transfer belt 51 may also be reduced.

Modifications

In an image forming apparatus 1C according to a modification, when the paper sheet P is a sheet of low resistance paper, such as metallic paper including a metal layer on the surface thereof or black paper containing carbon, and has a surface resistivity of 1E+6 Ω/sq. or less, or approximately 1E+6 Ω/sq. or less, the system control device 11 controls the moving mechanism 110 so that the center-to-center distance L1 between the backup roller 65 and the second transfer roller 54 is greater than the sum of the radius R1 of the backup roller 65 and the radius R2 of the second transfer roller 54. The system control device 11 sets the DC bias voltage Vbur so that the transfer current applied to the power feed roller 65A is within a predetermined range at the time when the paper sheet P becomes separated from the sheet guide 28.

More specifically, the DC bias voltage Vbur is increased so that the amount of current $I_{BTB}$ that flows along route RT1 is as large as the amount of transfer current $I_{PAPER}$ that flows along route RT2 when the paper sheet P is in contact with the sheet guide 28 (see FIG. 5).

Accordingly, when white (W) toner or silver (S) toner is used, image defects that occur in the region near the leading end L/E of the paper sheet P due to toner scattered rearward, that is, in the direction opposite to the transporting direction, may be reduced. In addition, image defects due to toner scattered rearward, that is, in the direction opposite to the transporting direction, from the intermediate transfer belt 51 may also be reduced. In addition, even when a low resistance paper sheet is used, the difference in density of the toner image in the transporting direction of the paper sheet P may be reduced.

Examples

The difference in density of a transferred toner image in the sheet transporting direction and image defects due to toner scattering are evaluated under the conditions described below. An apparatus based on Color 1000 Press manufactured by Fuji Xerox Co., Ltd. is used as the image forming apparatus 1, and 350 gsm A3-size metallic paper (SPECIALITIES No. 314) manufactured by Gojo Paper MFG. Co., Ltd. is used as low resistance paper.

The evaluated images include a full A3-size solid image colored only in white (W), a full A3-size solid image colored in a secondary color obtained by placing magenta (M) toner and cyan (C) toner on white (W) toner, and a band-shaped white image that extends from a position 20 mm away from the image leading end over a width of 10 mm in the transporting direction of the paper sheet P and that has a width of 285 mm in the direction orthogonal to the transporting direction of the paper sheet P. The temperature and humidity of the environment in which the evaluation is performed are 20° C. and 10% RH, respectively.

Condition 1

The amount of indentation in the second transfer nip is fixed to −0.3 mm (separated by 0.3 mm), and the DC bias voltage Vbur is fixed to −2.0 kV.

Condition 2

The amount of indentation in the second transfer nip is fixed to −0.3 mm (separated by 0.3 mm), and the DC bias voltage Vbur is set to −2.0 kV and changed to −2.9 kV at the time when the trailing end of the paper sheet leaves the sheet guide 28.

Condition 3

The amount of indentation in the second transfer nip is increased from −0.3 mm (separated by 0.3 mm) to +0.3 mm at the time when the trailing end of the paper sheet leaves the sheet guide 28, and the DC bias voltage Vbur is fixed to −2.0 kV.

Condition 4

The amount of indentation in the second transfer nip is fixed to +0.3 mm (indented by 0.3 mm), and the DC bias voltage Vbur is fixed to −2.0 kV.

Condition 5

The amount of indentation in the second transfer nip is fixed to +0.3 mm (indented by 0.3 mm), and the DC bias voltage Vbur is set to −2.0 kV and changed to −2.9 kV at the time when the trailing end of the paper sheet leaves the sheet guide 28.

FIG. 10 shows the image evaluation results under Conditions 1 to 5.

Condition 1

When the DC bias voltage Vbur is fixed to −2.0 kV, each of the full A3-size solid image colored only in white (W) and the full A3-size solid image colored in the secondary color (blue) obtained by placing magenta (M) toner and cyan (C) toner on white (W) toner has a clear density step due to a difference in density of the transferred toner image in the transporting direction of the paper sheet P. Tonner scattering does not occur when the band-shaped white image is formed.

Condition 2

In Condition 2, the DC bias voltage Vbur is increased at the time when the paper sheet trailing end T/E leaves the sheet guide 28, so that the electric field generated in a second-transfer opposing section is stronger when the paper sheet P is in contact only with the second transfer belt 53 in the second-transfer opposing section than when the paper sheet P is additionally in contact with the sheet guide 28. In this case, each of the full A3-size solid image colored only in white (W) and the full A3-size solid image colored in the secondary color (blue) obtained by placing magenta (M) toner and cyan (C) toner on white (W) toner has no difference in density of the transferred toner image in the transporting direction of the paper sheet P. Tonner scattering does not occur when the band-shaped white image is formed.

Condition 3

The amount of indentation in the second transfer nip is increased from −0.3 mm (separated by 0.3 mm) to +0.3 mm (indented by 0.3 mm) at the time when the paper sheet trailing end T/E leaves the sheet guide 28. Accordingly, the solid image colored only in white (W) has no difference in density in the transporting direction of the paper sheet P. The solid image colored in the secondary color obtained by placing magenta (M) toner and cyan (C) toner on white (W) toner has a difference in density that is smaller than that of the clear density step according to Condition 1 and that is reduced to an extent such that a difference in hue is somewhat noticeable. Tonner scattering does not occur when the band-shaped white image is formed.

Condition 4

The amount of indentation in the second transfer nip is fixed to +0.3 mm (indented by 0.3 mm). Accordingly, the solid image colored only in white (W) has no difference in density in the transporting direction of the paper sheet P. The solid image colored in the secondary color obtained by placing magenta (M) toner and cyan (C) toner on white (W) toner has a difference in density that is smaller than that of the clear density step according to Condition 1 and that is reduced to an extent such that a difference in hue is somewhat noticeable. Toner scattering occurs when the band-shaped white image is formed.

Condition 5

The amount of indentation in the second transfer nip is fixed to +0.3 mm (indented by 0.3 mm), and the DC bias voltage Vbur is increased at the time when the paper sheet trailing end T/E leaves the sheet guide 28. Accordingly, each of the full A3-size solid image colored only in white (W) and the full A3-size solid image colored in the secondary color (blue) obtained by placing magenta (M) toner and cyan (C) toner on white (W) toner has no difference in density of the transferred toner image in the transporting direction of the paper sheet P. Toner scattering occurs when the band-shaped white image is formed.

Figure 18A:
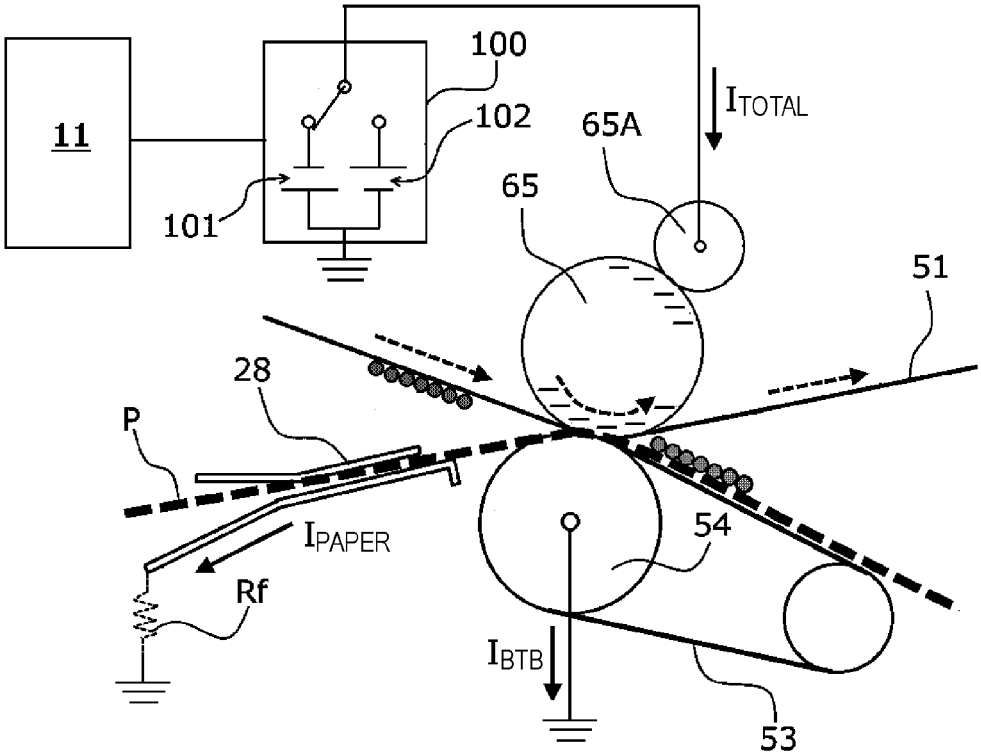
FIG. 18A illustrates a structure for applying a transfer bias in the second transfer unit when a sheet guide is resistance-grounded.
Figure 18B:
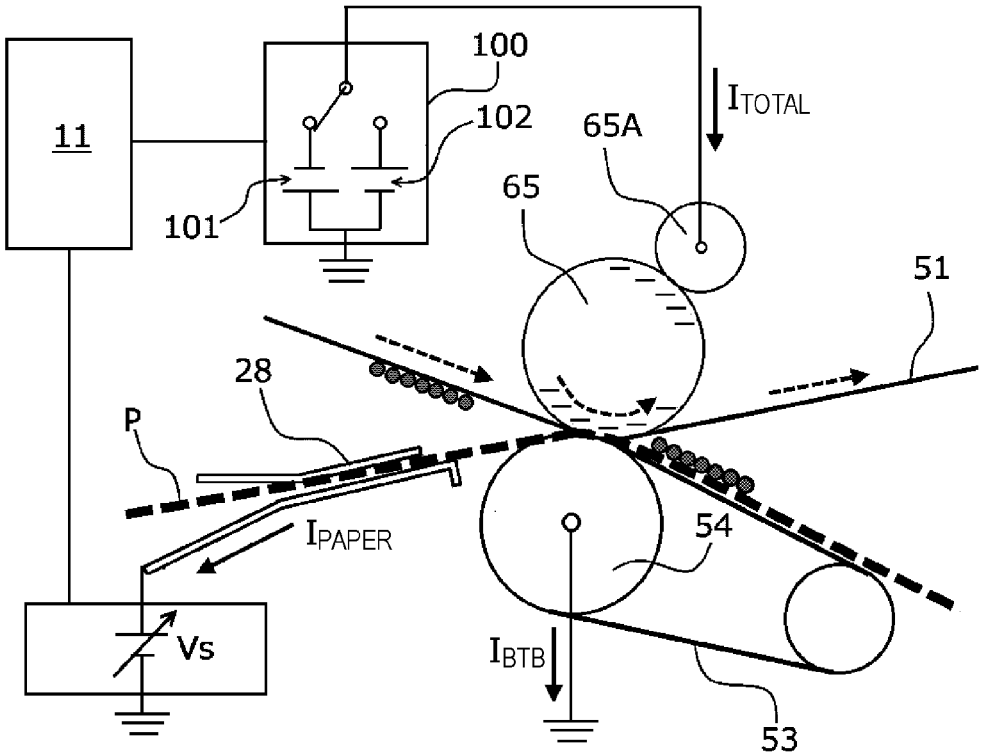
FIG. 18B illustrates a structure for applying a transfer bias in the second transfer unit when a bias voltage is applied to the sheet guide.

FIG. 18A illustrates a structure for applying a transfer bias in a second transfer unit when the sheet guide 28 is resistance-grounded, and FIG. 18B illustrates a structure for applying a transfer bias in a second transfer unit when a bias voltage is applied to the sheet guide 28.

In the image forming apparatuses according to the above-described exemplary embodiments, the sheet guide 28 is grounded. However, as illustrated in FIG. 18A, the sheet guide 28 may instead be grounded through a resistance Rf. When the resistance Rf is provided, the system resistance of route RT2 (route through the backup roller 65, the intermediate transfer belt 51, the paper sheet P, the sheet guide 28, and the resistance Rf) approaches the system resistance of route RT1 (route through the backup roller 65, the intermediate transfer belt 51, the paper sheet P, and the second transfer belt 53). As a result, the difference in transfer current between the period in which the paper sheet P is in contact with the sheet guide 28 and the period in which the paper sheet P is not in contact with the sheet guide 28 is reduced.

As illustrated in FIG. 18B, a predetermined bias voltage Vs having the same polarity as that of the DC bias voltage Vbur may be applied to the sheet guide 28 to reduce the difference between the current $I_{PAPER}$ that flows along route RT2 when the paper sheet P is in contact with the sheet guide 28 and the current $I_{BTB}$ that flows along route RT1 when the paper sheet P is not in contact with the sheet guide 28.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transfer unit having a plurality of rollers configured to transfer a toner image to a transfer body;

a sheet guide disposed upstream of the transfer unit in a direction in which the transfer body is transported, the sheet guide guiding the transfer body;

a power supply that supplies a transfer voltage to the transfer unit; and a system control device that sets the transfer voltage supplied by the power supply so that a transfer current supplied to the transfer unit is within a predetermined range at a time when the transfer body becomes separated from the sheet guide, wherein the system control device sets the transfer voltage supplied by the power supply so that the transfer current supplied to the transfer unit is within the predetermined range at the time when the transfer body becomes separated from the sheet guide if the transfer body is a recording medium having a metal layer on a surface thereof or a recording medium containing carbon, wherein the system control device sets the transfer voltage supplied to the transfer unit so that the transfer voltage is higher when the transfer body is not in contact with the sheet guide than when the transfer body is in contact with the sheet guide.

2. The image forming apparatus according to claim 1, wherein the system control device sets the transfer voltage supplied by the power supply so that the transfer current supplied to the transfer unit is within the predetermined range at the time when the transfer body becomes separated from the sheet guide if the transfer body has a surface resistivity of approximately 1E+6 Ω/sq. or less.

3. The image forming apparatus according to claim 1, wherein the system control device increases an amount of increase in the transfer voltage as a volume resistivity of the transfer body increases.

4. An image forming apparatus, comprising:

a transfer unit having a plurality of rollers configured to transfer a toner image to a transfer body;

a sheet guide disposed upstream of the transfer unit in a direction in which the transfer body is transported, the sheet guide guiding the transfer body;

a power supply that supplies a transfer voltage to the transfer unit; and a system control device that sets the transfer voltage supplied by the power supply so that a transfer current supplied to the transfer unit is within a predetermined range at a time when the transfer body becomes separated from the sheet guide, wherein the system control device sets the transfer voltage supplied by the power supply so that the transfer current supplied to the transfer unit is within the predetermined range at the time when the transfer body becomes separated from the sheet guide if the transfer body is a recording medium having a metal layer on a surface thereof or a recording medium containing carbon, wherein the transfer unit sets a pressing force applied to the transfer body so that the pressing force is greater when the transfer body is not in contact with the sheet guide than when the transfer body is in contact with the sheet guide.

5. An image forming apparatus, comprising:

a transfer unit having a plurality of rollers configured to transfer a toner image to a transfer body;

a sheet guide disposed upstream of the transfer unit in a direction in which the transfer body is transported, the sheet guide guiding the transfer body;

a power supply that supplies a transfer voltage to the transfer unit; and a system control device that sets the transfer voltage supplied by the power supply so that a transfer current supplied to the transfer unit is within a predetermined range at a time when the transfer body becomes separated from the sheet guide, wherein the system control device sets the transfer voltage supplied by the power supply so that the transfer current supplied to the transfer unit is within the predetermined range at the time when the transfer body becomes separated from the sheet guide if the transfer body is a recording medium having a metal layer on a surface thereof or a recording medium containing carbon, wherein the transfer unit includes a second transfer member that transfers the toner image to the transfer body in a second transfer process and an opposing member that opposes the second transfer member, and wherein a center-to-center distance between the opposing member and the second transfer member is smaller when the transfer body is not in contact with the sheet guide than when the transfer body is in contact with the sheet guide.

6. The image forming apparatus according to claim 5, wherein the center-to-center distance between the opposing member and the second transfer member is smaller than the sum of a radius of the opposing member and a radius of the second transfer member when the transfer body is in contact with the sheet guide, and is further reduced when the transfer body is not in contact with the sheet guide.

7. An image forming apparatus, comprising:

a transfer unit having a plurality of rollers configured to transfer a toner image to a transfer body;

a sheet guide disposed upstream of the transfer unit in a direction in which the transfer body is transported, the sheet guide guiding the transfer body;

a power supply that supplies a transfer voltage to the transfer unit; and a system control device that sets the transfer voltage supplied by the power supply so that a transfer current supplied to the transfer unit is within a predetermined range at a time when the transfer body becomes separated from the sheet guide, wherein the system control device sets the transfer voltage supplied by the power supply so that the transfer current supplied to the transfer unit is within the predetermined range at the time when the transfer body becomes separated from the sheet guide if the transfer body is a recording medium having a metal layer on a surface thereof or a recording medium containing carbon, wherein the transfer unit includes a second transfer member that transfers the toner image to the transfer body in a second transfer process and an opposing member that opposes the second transfer member, and wherein a center-to-center distance between the opposing member and the second transfer member is greater than the sum of a radius of the opposing member and a radius of the second transfer member when the transfer body is in contact with the sheet guide.

8. The image forming apparatus according to claim 7, wherein the center-to-center distance between the opposing member and the second transfer member is reduced when the transfer body is not in contact with the sheet guide.

9. The image forming apparatus according to claim 7, wherein the sheet guide is electrically grounded.

10. The image forming apparatus according to claim 7, wherein the sheet guide is grounded through an electrical resistance.

11. The image forming apparatus according to claim 7, wherein a voltage having a polarity that is the same as a polarity of the transfer voltage is applied to the sheet guide.

12. The image forming apparatus according to claim 7, wherein the toner image includes a white toner layer made of white toner or a silver toner layer made of silver toner containing aluminum pigment.

13. An image forming apparatus comprising:

transfer means for transferring a toner image to a transfer body;

guide means, disposed upstream of the transfer means in a direction in which the transfer body is transported, for guiding the transfer body;

supply means for supplying a transfer voltage to the transfer means; and setting means for setting the transfer voltage supplied by the supply means so that a transfer current supplied to the transfer means is within a predetermined range at a time when the transfer body becomes separated from the guide means, wherein the setting means sets the transfer voltage supplied by the supply means so that the transfer current supplied to the transfer means is within the predetermined range at the time when the transfer body becomes separated from the guide means if the transfer body is a recording medium having a metal layer on a surface thereof or a recording medium containing carbon, wherein the setting means sets the transfer voltage supplied to the transfer means so that the transfer voltage is higher when the transfer body is not in contact with the guide means than when the transfer body is in contact with the guide means.

* * * * *